US008287720B2

(12) United States Patent
Baldassari et al.

(10) Patent No.: US 8,287,720 B2
(45) Date of Patent: Oct. 16, 2012

(54) MULTISTAGE RESID HYDROCRACKING

(75) Inventors: Mario C. Baldassari, Morris Plains, NJ (US); Ujjal K. Mukherjee, Montclair, NJ (US); Avinash Gupta, Bloomfield, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 742 days.

(21) Appl. No.: 12/490,089

(22) Filed: Jun. 23, 2009

(65) Prior Publication Data

US 2010/0320122 A1 Dec. 23, 2010

(51) Int. Cl.

| | |
|---|---|
| ***C10G 67/04*** | (2006.01) |
| ***C10G 65/14*** | (2006.01) |
| ***C10G 21/00*** | (2006.01) |
| ***C10G 47/00*** | (2006.01) |
| ***C10G 49/22*** | (2006.01) |

(52) U.S. Cl. ..... 208/96; 208/78; 208/102; 208/108

(58) Field of Classification Search ..... 208/78, 208/96, 102, 108

See application file for complete search history.

(56) References Cited

U.S. PATENT DOCUMENTS

| | | | | |
|---|---|---|---|---|
| 4,062,758 | A * | 12/1977 | Goudriaan et al. | 208/108 |
| 4,176,048 | A | 11/1979 | Corns et al. | |
| 4,239,616 | A | 12/1980 | Gearhart | |
| 4,354,922 | A | 10/1982 | Derbyshire et al. | |
| 4,354,928 | A | 10/1982 | Audeh et al. | |
| 4,440,633 | A | 4/1984 | Jacquin et al. | |
| 4,536,283 | A | 8/1985 | Davis | |
| 4,640,762 | A | 2/1987 | Woods et al. | |
| 6,436,279 | B1 * | 8/2002 | Colyar | 208/108 |
| 7,214,308 | B2 | 5/2007 | Colyar | |
| 7,279,090 | B2 | 10/2007 | Colyar et al. | |
| 2006/0157385 | A1 * | 7/2006 | Montanari et al. | 208/49 |

FOREIGN PATENT DOCUMENTS

| | | |
|---|---|---|
| EP | 0 403 087 | 12/1990 |
| FR | 2 906 813 | 4/2008 |
| GB | 1 560 148 | 1/1980 |
| WO | WO 2008/014947 | 2/2008 |

OTHER PUBLICATIONS

International Search Report and Written Opinion of the International Searching Authority, International Patent Application No. PCT/US2010/001736, mailed Sep. 24, 2010.

* cited by examiner

*Primary Examiner* — Randy Boyer
(74) *Attorney, Agent, or Firm* — Osha • Liang LLP

(57) ABSTRACT

Processes for upgrading resid hydrocarbon feeds are disclosed. The upgrading processes may include: hydrocracking a resid in a first reaction stage to form a first stage effluent; hydrocracking a deasphalted oil fraction in a second reaction stage to form a second stage effluent; fractionating the first stage effluent and the second stage effluent to recover at least one distillate hydrocarbon fraction and a resid hydrocarbon fraction; feeding the resid hydrocarbon fraction to a solvent deasphalting unit to provide an asphaltene fraction and the deasphalted oil fraction.

15 Claims, 4 Drawing Sheets

Figure 3 (Comparative Example)

MULTISTAGE RESID HYDROCRACKING

BACKGROUND OF DISCLOSURE

1. Field of the Disclosure

Embodiments disclosed herein relate generally to process for upgrading petroleum feedstocks. In one aspect, embodiments disclosed herein relate to a process for hydrocracking and deasphalting resid. In another aspect, embodiments disclosed herein relate to an integrated process for upgrading resid including multiple hydrocracking stages.

2. Background

Hydrocarbon compounds are useful for a number of purposes. In particular, hydrocarbon compounds are useful, inter alia, as fuels, solvents, degreasers, cleaning agents, and polymer precursors. The most important source of hydrocarbon compounds is petroleum crude oil. Refining of crude oil into separate hydrocarbon compound fractions is a well-known processing technique.

Crude oils range widely in their composition and physical and chemical properties. Heavy crudes are characterized by a relatively high viscosity, low API gravity, and high percentage of high boiling components (i.e., having a normal boiling point of greater than 510° C. (950° F.)).

Refined petroleum products generally have higher average hydrogen to carbon ratios on a molecular basis. Therefore, the upgrading of a petroleum refinery hydrocarbon fraction is generally classified into one of two categories: hydrogen addition and carbon rejection. Hydrogen addition is performed by processes such as hydrocracking and hydrotreating. Carbon rejection processes typically produce a stream of rejected high carbon material which may be a liquid or a solid; e.g., coke deposits.

Hydrocracking processes can be used to upgrade higher boiling materials, such as resid, typically present in heavy crude oil by converting them into more valuable lower boiling materials. For example, at least a portion of the resid feed to a hydrocracking reactor may be converted to a hydrocracking reaction product. The unreacted resid may be recovered from the hydrocracking process and either removed or recycled back to the hydrocracking reactor in order to increase the overall resid conversion.

The resid conversion in a hydrocracking reactor can depend on a variety of factors, including feedstock composition; the type of reactor used; the reaction severity, including temperature and pressure conditions; reactor space velocity; and catalyst type and performance. In particular, the reaction severity may be used to increase the conversion. However, as the reaction severity increases, side reactions may occur inside the hydrocracking reactor to produce various byproducts in the form of coke precursors, sediments, other deposits as well as byproducts which form a secondary liquid phase. Excessive formation of such sediments can hinder subsequent processing and can deactivate the hydrocracking catalyst by poisoning, coking, or fouling. Deactivation of the hydrocracking catalyst can not only significantly reduce the resid conversion, but can also require more frequent change-outs of expensive catalyst. Formation of a secondary liquid phase not only deactivates the hydrocracking catalyst, but also limits the maximum conversion, thereby resulting in a higher catalyst consumption which can defluidize the catalyst. This leads to formation of "hot zones" within the catalyst bed, exacerbating the formation of coke, which further deactivates the hydrocracking catalyst.

Sediment formation inside the hydrocracking reactor is also a strong function of the feedstock quality. For example, asphaltenes that may be present in the resid feed to the hydrocracking reactor system are especially prone to forming sediments when subjected to severe operating conditions. Thus, separation of the asphaltenes from the resid in order to increase the conversion may be desirable.

One type of processes that may be used to remove such asphaltenes from the heavy hydrocarbon residue feed is solvent deasphalting. For example, solvent deasphalting typically involves physically separating the lighter hydrocarbons and the heavier hydrocarbons including asphaltenes based on their relative affinities for the solvent. A light solvent such as a $C_3$ to $C_7$ hydrocarbon can be used to dissolve or suspend the lighter hydrocarbons, commonly referred to as deasphalted oil, allowing the asphaltenes to be precipitated. The two phases are then separated and the solvent is recovered. Additional information on solvent deasphalting conditions, solvents and operations may be obtained from U.S. Pat. Nos. 4,239,616; 4,440,633; 4,354,922; 4,354,928; and 4,536,283.

Several methods for integrating solvent deasphalting with hydrocracking in order to remove asphaltenes from resid are available. One such process is disclosed in U.S. Pat. Nos. 7,214,308 and 7,279,090. These patents disclose contacting the residue feed in a solvent deasphalting system to separate the asphaltenes from deasphalted oil. The deasphalted oil and the asphaltenes are then each reacted in separate hydrocracking reactor systems.

Moderate overall resid conversions (about 65% to 70% as described in U.S. Pat. No. 7,214,308) may be achieved using such processes, as both the deasphalted oil and the asphaltenes are separately hydrocracked. However, the hydrocracking of asphaltenes as disclosed is at high severity/high conversion, and may present special challenges, as discussed above. For example, operating the asphaltenes hydrocracker at high severity in order to increase the conversion may also cause a high rate of sediment formation, and a high rate of catalyst replacement. In contrast, operating the asphaltenes hydrocracker at low severity will suppress sediment formation, but the per-pass conversion of asphaltenes will be low. In order to achieve a higher overall resid conversion, such processes typically require a high recycle rate of the unreacted resid back to one or more of the hydrocracking reactors. Such high-volume recycle can significantly increase the size of the hydrocracking reactor and/or the upstream solvent deasphalting system.

Accordingly, there exists a need for improved resid hydrocracking processes that achieve a high resid conversion, reduce the overall equipment size of hydrocracking reactor and/or solvent deasphalter, and require less frequent hydrocracking catalyst change-outs.

SUMMARY OF THE DISCLOSURE

In one aspect, embodiments disclosed herein relate to a process for upgrading resid. The process may include: hydrocracking a resid in a first reaction stage to form a first stage effluent; hydrocracking a deasphalted oil fraction in a second reaction stage to form a second stage effluent; fractionating the first stage effluent and the second stage effluent to recover at least one distillate hydrocarbon fraction and a resid hydrocarbon fraction; feeding the resid hydrocarbon fraction to a solvent deasphalting unit to provide an asphaltene fraction and the deasphalted oil fraction.

In another aspect, embodiments disclosed herein relate to a process for upgrading resid. The process may include: feeding hydrogen and a resid hydrocarbon to a first reactor containing a first hydrocracking catalyst; contacting the resid and hydrogen in the presence of the hydrocracking catalyst at conditions of temperature and pressure to crack at least a portion of the resid; recovering an effluent from the first reactor; feeding hydrogen and a deasphalted oil fraction to a second reactor containing a second hydrocracking catalyst; contacting the deasphalted oil fraction and hydrogen in the presence of the second hydrocracking catalyst at conditions of temperature and pressure to crack at least a portion of the deasphalted oil; recovering an effluent from the second reactor; fractionating the first reactor effluent and the second reactor effluent to form at least one distillate hydrocarbon fraction and at least one resid hydrocarbon fraction; feeding the at least one resid hydrocarbon fraction to a solvent deasphalting unit to provide an asphaltene fraction and the deasphalted oil fraction.

Other aspects and advantages will be apparent from the following description and the appended claims.

DETAILED DESCRIPTION

Figure 1:
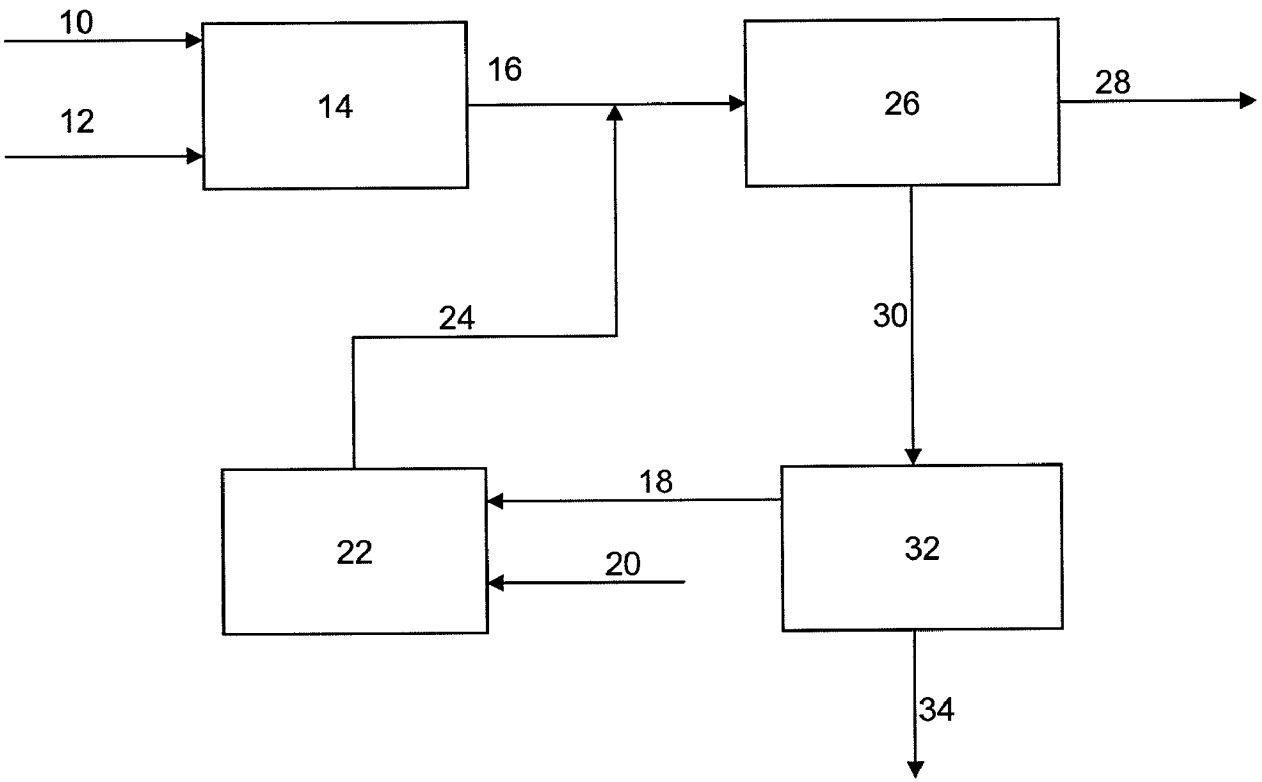
FIG. 1 is a simplified flow diagram of a hydrocracking and deasphalting process according to embodiments disclosed herein.

Embodiments disclosed herein relate generally to process for upgrading petroleum feedstocks. In one aspect, embodiments disclosed herein relate to a process for hydrocracking and deasphalting resid. In another aspect, embodiments disclosed herein relate to an integrated process for upgrading resid including multiple hydrocracking stages.

Residuum hydrocarbon (resid) feedstocks useful in embodiments disclosed herein may include various heavy crude and refinery fractions. For example, resid hydrocarbon feedstocks may include fresh resid hydrocarbon feeds, petroleum atmospheric or vacuum residue, hydrocracked atmospheric tower or vacuum tower bottoms, straight run vacuum gas oil, hydrocracked vacuum gas oil, fluid catalytically cracked (FCC) slurry oils or cycle oils, as well as other similar hydrocarbon streams, or a combination thereof, each of which may be straight run, process derived, hydrocracked, partially desulfurized, and/or low-metal streams. The above resid feedstocks may include various impurities, including asphaltenes, metals, organic sulfur, organic nitrogen, and Conradson carbon residue (CCR). The initial boiling point of the resid is typically greater than about 350° C.

Processes according to embodiments disclosed herein for conversion of resid hydrocarbon feedstocks to lighter hydrocarbons include initially hydrocracking the resid feedstock, including any asphaltenes contained therein. The entire resid feed, including asphaltenes, may be reacted with hydrogen over a hydrocracking catalyst in a first hydrocracking reaction stage to convert at least a portion of the hydrocarbons to lighter molecules, including the conversion of at least a portion of the asphaltenes. In order to mitigate sediment formation, the first stage hydrocracking reaction may be conducted at temperatures and pressures that may avoid high rates of sediment formation and catalyst fouling (i.e., "moderate severity" reaction conditions). Resid conversion in the first reaction stage may be in the range from about 30 wt % to about 75 wt % in some embodiments.

The reaction product from the first stage may then be separated to recover at least one distillate hydrocarbon fraction and a resid fraction including unreacted resid feed, asphaltenes, and any resid-boiling range products resulting from hydrocracking of the asphaltenes contained in the resid feedstock. Distillate hydrocarbon fractions recovered may include, among others, atmospheric distillates, such as hydrocarbons having a normal boiling temperature of less than about 340° C., and vacuum distillates, such as hydrocarbons having a normal boiling temperature of from about 468° C. to about 579° C.

The resid fraction may then be separated in a solvent deasphalting unit to recover a deasphalted oil fraction and an asphaltenes fraction. The solvent deasphalting unit may be, for example, as described in one or more of U.S. Pat. Nos. 4,239,616, 4,440,633, 4,354,922, 4,354,928, 4,536,283, and 7,214,308, each of which is incorporated herein by reference to the extent not contradictory to embodiments disclosed herein. In the solvent deasphalting unit, a light hydrocarbon solvent may be used to selectively dissolve desired components of the resid fraction and reject the asphaltenes. In some embodiments, the light hydrocarbon solvent may be a $C_3$ to $C_7$ hydrocarbon, and may include propane, butane, isobutane, pentane, isopentane, hexane, heptane, and mixtures thereof.

The deasphalted oil fraction may be reacted with hydrogen over a hydrocracking catalyst in a second hydrocracking reaction stage to convert at least a portion of the hydrocarbons to lighter molecules. The reaction product from the second hydrocracking reaction stage may then be separated along with the reaction product from the first hydrocracking stage to recover distillate range hydrocarbons produced in both the first and second hydrocracking reaction stages.

Processes according to embodiments disclosed herein thus include a solvent deasphalting unit downstream of the first hydrocracking reaction stage, providing for conversion of at least a portion of the asphaltenes to lighter, more valuable hydrocarbons. Hydrocracking of asphaltenes in the first reaction stage may provide for overall resid conversions that may be greater than about 60 wt % in some embodiments; greater than 85 wt % in other embodiments; and greater than 95 wt % in yet other embodiments. Additionally, due to conversion of at least a portion of the asphaltenes upstream, the required size for solvent deasphalting units used in embodiments may be less than would be required where the entire resid feed is initially processed.

Catalysts used in the first and second reaction stages may be the same or different. Suitable hydrotreating and hydrocracking catalysts useful in the first and second reaction stages may include one or more elements selected from Groups 4-12 of the Periodic Table of the Elements. In some embodiments, the hydrotreating and hydrocracking catalysts according to embodiments disclosed herein may comprise, consist of, or consist essentially of one or more of nickel, cobalt, tungsten, molybdenum and combinations thereof, either unsupported or supported on a porous substrate such as silica, alumina, titania, or combinations thereof. As supplied from a manufacturer or as resulting from a regeneration process, the hydroconversion catalysts may be in the form of metal oxides, for example. If necessary or desired, the metal oxides may be converted to metal sulfides prior to or during use. In some embodiments, the hydrocracking catalysts may be pre-sulfided and/or pre-conditioned prior to introduction to the hydrocracking reactor.

The first hydrotreating and hydrocracking reaction stage may include one or more reactors in series and/or parallel.

Reactors suitable for use in the first hydrotreating and hydrocracking reaction stage may include any type of hydrocracking reactor. Ebullated bed reactors and fluidized bed reactors are preferred due to the processing of asphaltenes in the first reaction stage. In some embodiments, the first hydrocracking reaction stage includes only a single ebullated bed reactor.

The second hydrocracking reaction stage may include one or more reactors in series and/or parallel. Reactors suitable for use in the second hydrocracking reaction stage may include any type of hydrocracking reactor, including ebullated bed reactors, fluidized bed reactors, and fixed bed reactors, among others. Asphaltenes may be present in the deasphalted oil only to a minor extent, thus a wide variety of reactor types may be used in the second reaction stage. For instance, a fixed bed reactor may be considered where the metals and Conradson carbon residue of the deasphalted oil fraction fed to the second hydrocracking reaction stage is less than 80 wppm and 10%, respectively. The number of reactors required may depend on the feed rate, the overall target resid conversion level, and the level of conversion attained in the first hydrocracking reaction stage.

The fractionating of effluents from first and second reaction stages can be achieved in separate, independent fractionation systems, or more preferably, in a common fractionation system placed intermediate to the two hydrocracking reaction stages. Furthermore, it is contemplated that the reaction product from the second stage may be separated along with or independently from the reaction product from the first stage reaction.

The hydrocracking reaction in each of the first and second reaction stages may be conducted at a temperature in the range from about 360° C. to about 480° C.; from about 400° C. to about 450° C. in other embodiments. Pressures in each of the first and second reaction stages may be in the range from about 70 bara to about 230 bara in some embodiments; from about 100 to about 180 bara in other embodiments. The hydrocracking reactions may also be conducted at a liquid hourly space velocity (LHSV) in the range from about 0.1 $hr^{-1}$ to about 3.0 $hr^{-1}$ in some embodiments; from about 0.2 $hr^{-1}$ to about 2 in other embodiments.

In some embodiments, operating conditions in the first reaction stage may be less severe than those used in the second reaction stage, thus avoiding excessive catalyst replacement rates. Accordingly, overall catalyst replacement (i.e., for both stages combined) is also reduced. For example, the temperature in the first reaction stage may be less than the temperature in the second reaction stage. Operating conditions may be selected based upon the resid feedstock, including the content of impurities in the resid feedstock and the desired level of impurities to be removed in the first stage, among other factors. In some embodiments, resid conversion in the first reaction stage may be in the range from about 30 to about 60 wt %; from about 45 to about 55 wt % in other embodiments; and less than 50 wt % in yet other embodiments. In addition to hydrocracking the resid, sulfur and metal removal may each be in the range from about 40% to about 75%, and Conradson carbon removal may be in the range from about 30% to about 60%. In other embodiments, at least one of an operating temperature and an operating pressure in the first reaction stage may be greater than used in the second reaction stage.

Although resid conversion in the first reaction stage may be purposefully reduced to prevent catalyst fouling, overall resid conversions for processes according to embodiments disclosed herein may be greater than 80% due to the partial conversion of asphaltenes in the first reaction stage and the conversion of DAO in the second reaction stage. Using process flow schemes according to embodiments disclosed herein, overall resid conversions of at least 80%, 85%, 90% or higher may be attained, which is a significant improvement over what can be achieved with a two-stage hydrocracking system alone.

Referring now to FIG. 1, a simplified process flow diagram of processes for upgrading resid according to embodiments disclosed herein is illustrated. Pumps, valves, heat exchangers, and other equipment are not shown for ease of illustration of embodiments disclosed herein.

A resid and hydrogen may be fed via flow lines 10 and 12, respectively, to a first hydrocracking reaction stage 14 containing a hydrocracking catalyst and operating at a temperature and pressure sufficient to convert at least a portion of the resid to lighter hydrocarbons. The first stage reactor effluent may be recovered via flow line 16. As described above, the first stage effluent may include reaction products and unreacted resid, which may include unreacted feed components such as asphaltenes, and hydrocracked asphaltenes having various boiling points, including those in the boiling range of the resid feedstock.

A deasphalted oil fraction and hydrogen may be fed via flow lines 18 and 20, respectively, to a second hydrocracking reaction stage 22 containing a hydrocracking catalyst and operating at a temperature and pressure to convert at least a portion of the deasphalted oil to lighter hydrocarbons. The second stage reactor effluent may be recovered via flow line 24.

The first stage effluent and the second stage effluent in flow lines 16, 24 may then be fed to a separation system 26. In separation system 26, the first and second stage effluents may be fractionated to recover at least one distillate hydrocarbon fraction and a hydrocarbon fraction including the unreacted resid, asphaltenes, and similar boiling range compounds formed from hydrocracking of the asphaltenes. The distillate hydrocarbon fractions may be recovered via one or more flow lines 28.

The hydrocarbon fraction including the unreacted resid and asphaltenes may be fed via flow line 30 to solvent deasphalting unit 32 to produce an asphaltenes fraction recovered via flow line 34 and a deasphalted oil fraction. The deasphalted oil fraction may be recovered from solvent deasphalting unit 32 via flow line 18 and fed to second hydrocracking reaction stage 22, as described above.

Figure 2:
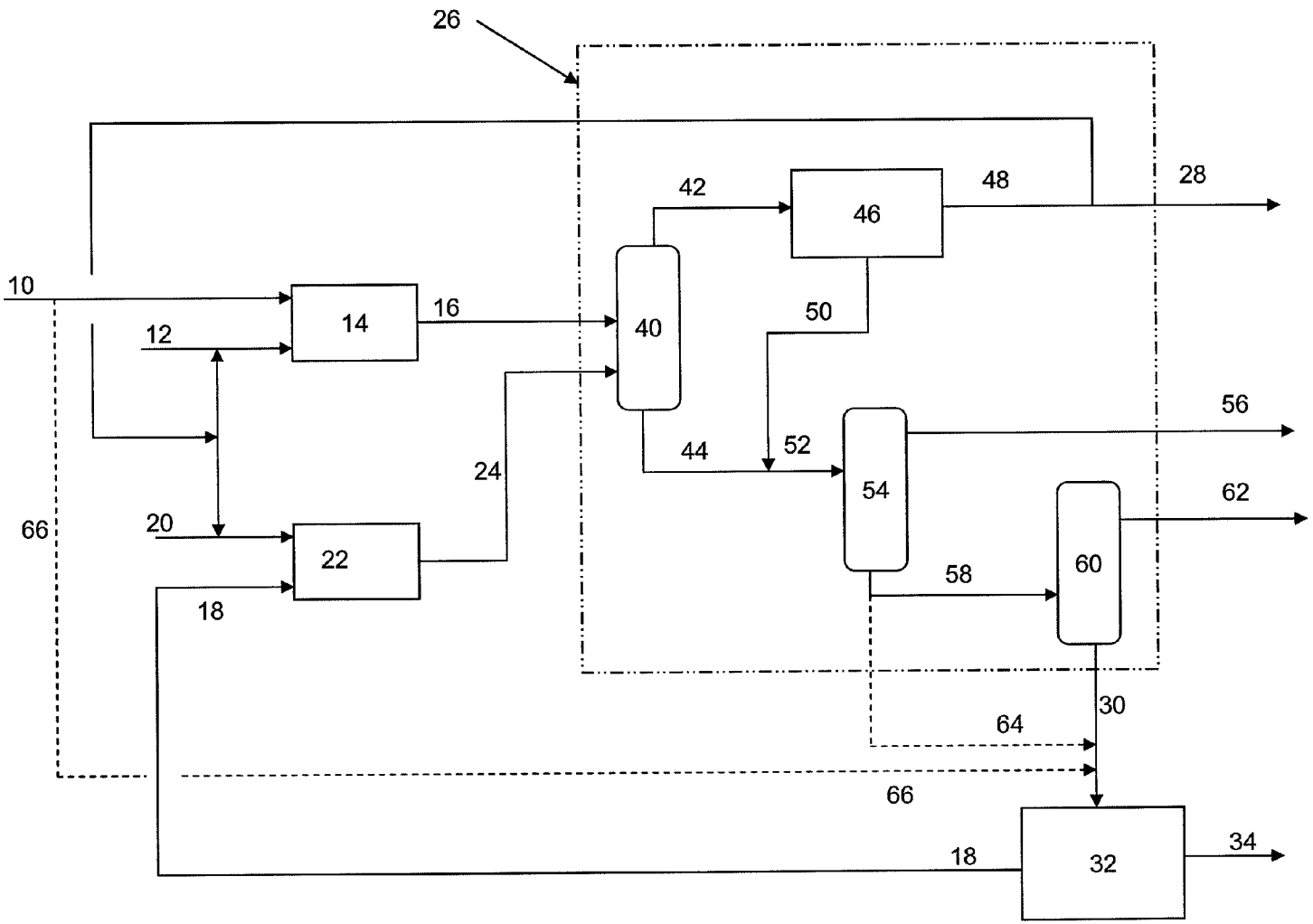
FIG. 2 is a simplified flow diagram of a hydrocracking and deasphalting process according to embodiments disclosed herein.

Referring now to FIG. 2, a simplified process flow diagram of processes for upgrading resid according to embodiments disclosed herein is illustrated, where like numerals represent like parts. As described for FIG. 1, the first stage reactor effluent and the second stage reactor effluent may be fed via flow lines 16, 24 to separation system 26. In this embodiment, separation system 26 may include a high pressure high temperature separator 40 (HP/HT separator) for separating the effluent liquid and vapor. The separated vapor may be recovered via flow line 42, and the separated liquid may be recovered via flow line 44

The vapor may then be directed via flow line 42 to a gas cooling, purification, and recycle compression system 46. A hydrogen-containing gas may be recovered from system 46 via flow line 48, a portion of which may be recycled to reactors 14, 16. Hydrocarbons condensed during the cooling and purification may be recovered via flow 50 and combined with the separated liquid in flow line 44 for further processing. The combined liquid stream 52 may then be fed to an atmospheric distillation tower 54 to separate the stream into a fraction including hydrocarbons boiling in a range of atmospheric distillates and a first bottoms fraction including hydrocarbons having a normal boiling point of at least 340°

C. The atmospheric distillates may be recovered via flow line 56, and the first bottoms fraction may be recovered via flow line 58.

The first bottoms fraction may then be fed to a vacuum distillation system 60 for separating the first bottoms fraction into a fraction including hydrocarbons boiling in a range of vacuum distillates and a second bottoms fraction including hydrocarbons having a normal boiling point of at least 480° C. The vacuum distillates may be recovered via flow line 62, and the second bottoms fraction may be recovered via flow line 30 and processed in the solvent deasphalting unit 32 as described above.

It may be necessary to reduce the temperature of the second bottoms fraction prior to feeding the second bottoms fraction to solvent deasphalting unit 32. The second bottoms fraction may be cooled via indirect or direct heat exchange. Due to fouling of indirect heat exchange systems that often occurs with vacuum tower residues, direct heat exchange may be preferred, and may be performed, for example, by contacting the second bottoms fraction with at least one of a portion of the first bottoms fraction and a portion of the neat resid feed, such as may be fed via flow lines 64 and 66, respectively.

As illustrated in FIG. 2, processes disclosed herein may include a stand-alone gas cooling, purification and compression system 46. In other embodiments, the vapor fraction recovered via flow line 42, or at least a portion thereof, may be processed in a common gas cooling, purification, and compression system, integrating the gas processing with other hydroprocessing units on site.

Although not illustrated, at least a portion of the asphaltenes recovered via flow line 34 may be recycled to the first hycrocracking reactor stage in some embodiments. Upgrading or otherwise using asphaltenes recovered via flow line 34 may be performed using other various processes known to one skilled in the art. For example, the asphaltenes may be blended with a cutter such as FCC slurry oil and used as fuel oil, or processed alone or in combination with other feeds to delayed coking or gasification units, or pelletized to asphalt pellets.

EXAMPLES

The following examples are derived from modeling techniques. Although the work has been performed, the Inventors do not present these examples in the past tense to comply with applicable rules.

In the examples presented below, FIG. 3 (Comparative Example 1) is a process for upgrading resid, a standalone LC-FINING unit designed to produce stable low sulfur fuel oil, where the reactor data is based upon actual commercial plant performance data. FIG. 4 (Example 1) is a process for upgrading resid according to embodiments disclosed herein. The following description and comparative data, including key reaction parameters presented in Table 1, provides a comparison between the standalone process and an integrated process according to embodiments disclosed herein.

Comparative Example 1

Figure 3:
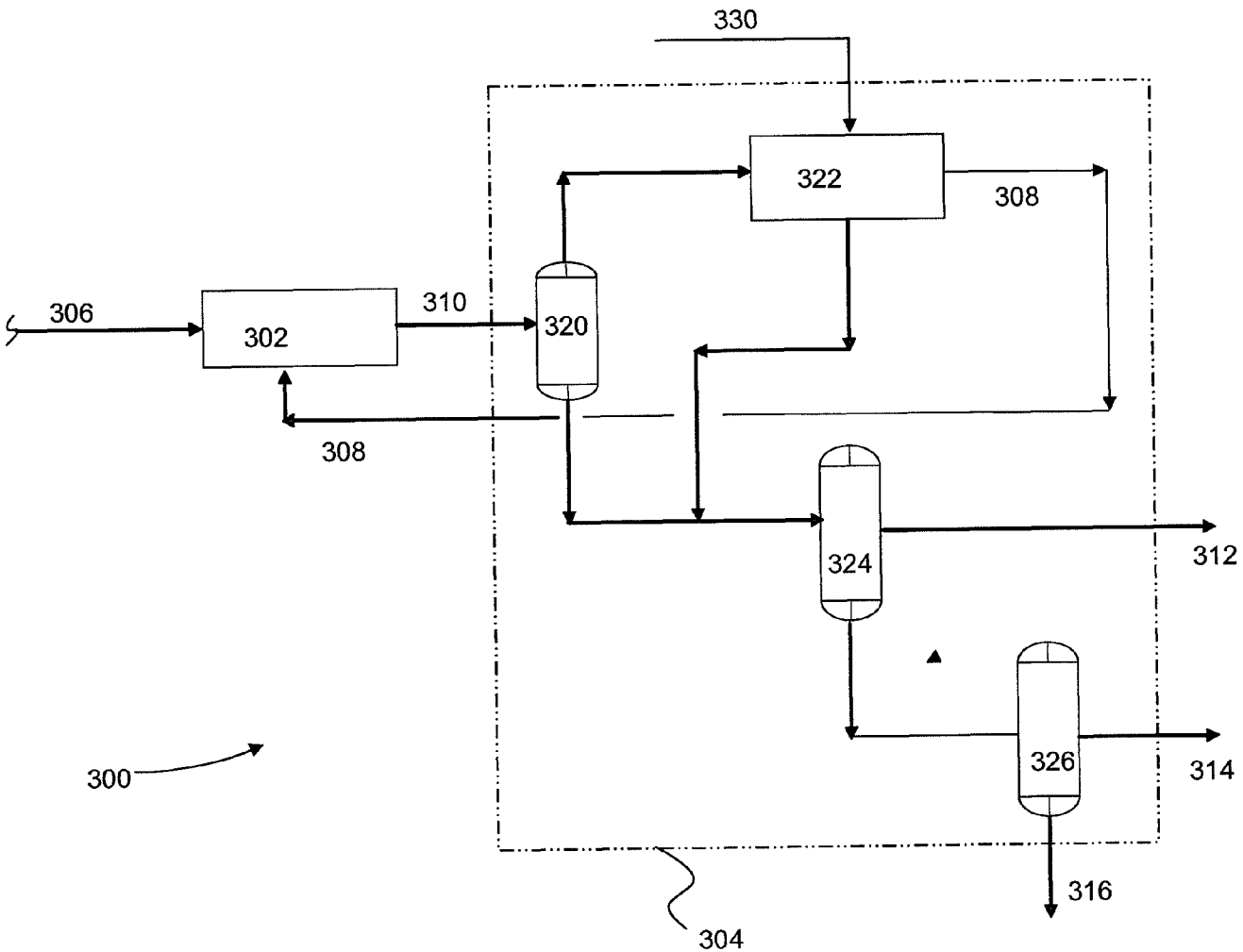
FIG. 3 is a simplified flow diagram of a process for upgrading resid for comparison to processes according to embodiments disclosed herein.
Figure 4:
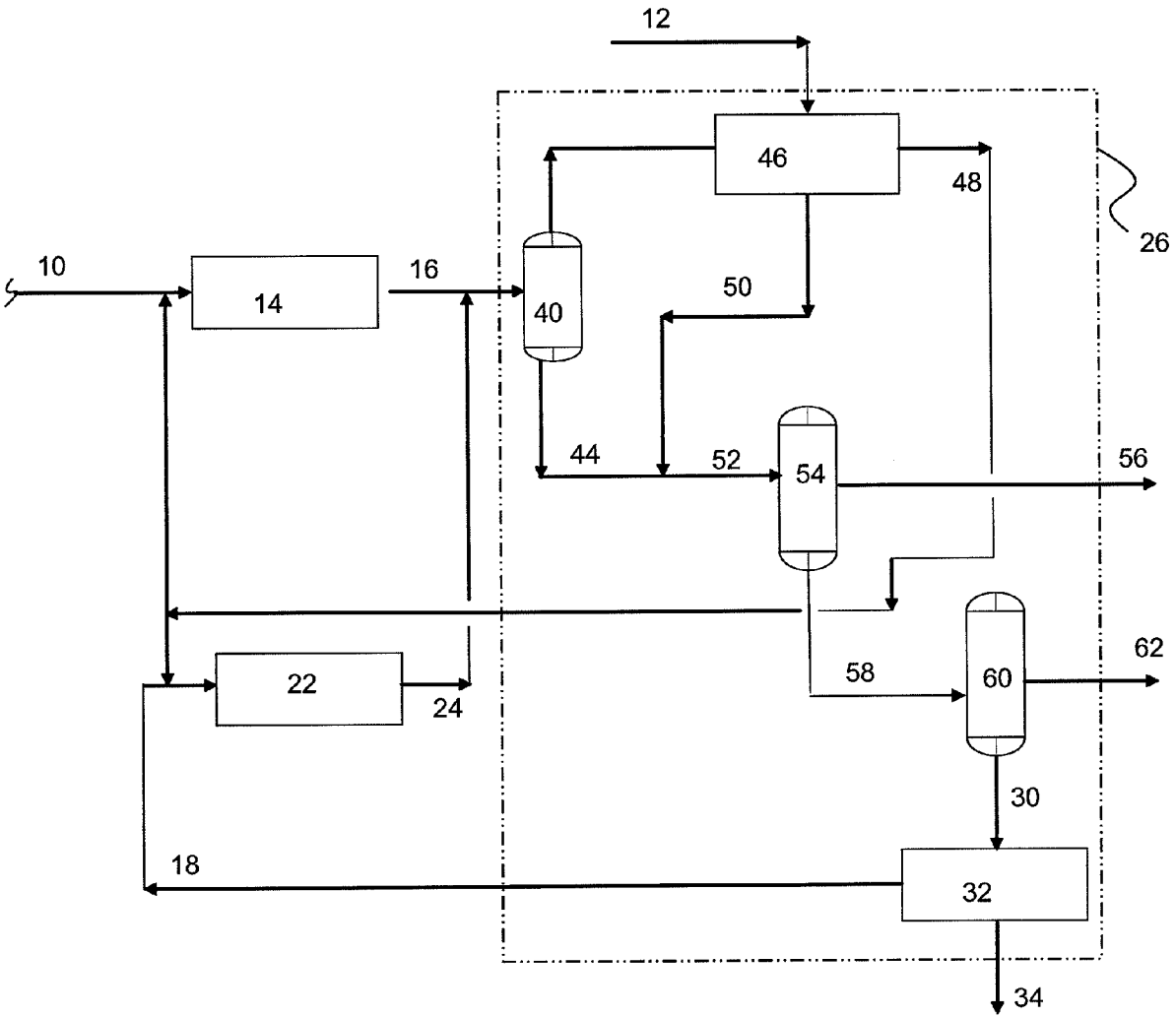
FIG. 4 is a simplified flow diagram of a hydrocracking and deasphalting process according to embodiments disclosed herein.

A comparative system 300 for upgrading resid is illustrated in FIG. 3, and includes a reaction section 302 and a separation system 304. Reaction section 302, for example, may include a single cracking reaction stage, such as an LC-FINING reaction system having three reactors in series. Resid and hydrogen are fed via flow lines 306 and 308, respectively, to reactor section 302 for cracking/upgrading of the resid. Effluent from reactor section 302 is then fed via flow line 310 to separation system 304 for fractionating the reactor effluent into desired fractions, including atmospheric distillates and vacuum distillates, recovered via flow lines 312 and 314, respectively, and a vacuum residue, recovered via flow line 316.

As illustrated in FIG. 3, separation system 304 includes a high pressure high temperature separator 320, a gas cooling, purification, and compression system 322, an atmospheric fractionation tower 324, and a vacuum fractionation tower 326. Fresh or make-up hydrogen is fed to the gas cooling, purification, and compression system 322 via flow line 330, mixed with unreacted hydrogen and other light gases recovered in gas system 322, and forwarded to reactor section 302 via flow line 308.

The total feed rate of resid (via flow line 306) to reactor section 302 is approximately 25000 barrels per stream day (BPSD). Reactor Section 302 is operated at a temperature and pressure sufficient to react approximately 62% of the resid. Separation of the reactor effluent recovered via flow line 310 results in recovery of approximately 8250 BPSD atmospheric distillates via flow line 312, 7620 BPSD vacuum distillates via flow line 314, and 10060 BPSD vacuum residue via flow line 316. An overall resid conversion of approximately 62% is achieved.

Example 1

A process for upgrading resid according to embodiments is simulated with a flowsheet as illustrated in FIG. 4, which is similar to FIG. 2. As such, reference numerals for FIG. 2 are used to represent the same components in FIG. 4, and the description of the process flow is not repeated here. As with FIG. 3, the fresh/make-up hydrogen is fed via flow line 12 to the gas cooling, purification, and compression system 46. Reaction stage 14 includes one reactor, and reaction stage 22 includes two reactors in series.

The total feed rate of resid (via flow line 10) to first reactor stage 14 is approximately 40000 BPSD. First reactor stage 14 is operated at a temperature and pressure sufficient to react approximately 52% of the resid. Second reactor stage 22 is operated at a temperature and pressure sufficient to react approximately 85% of the DAO feed. Combined separation of the first and second stage effluents recovered via flow lines 16 and 24, respectively, results in the recovery of 17825 BPSD atmospheric distillates recovered via flow line 56, 17745 BPSD vacuum distillates recovered via flow line 62, and 22705 BPSD vacuum residue recovered via flow line 34. The vacuum residue is then processed in solvent deasphalting unit 32, operating at approximately 75% lift and recovery and feed via flow line 18 of approximately 17030 BPSD DAO to second reaction stage 22. An overall resid conversion of approximately 84.3% is achieved.

As shown by the examples above, the overall residue conversion can be increased by more than 22% to 84.3% using processes according to embodiments disclosed herein (Example 1) as compared to a standalone LC-FINING unit (Comparative Example 1). The results of the Example 1 and Comparative Example 1 are further compared in Table 1.

TABLE 1

| | Comparative Example 1 | Example 1 | Example 1 |
|---|---|---|---|
| Stage | — | 1 | 2 |
| Resid Conversion, 975 + vol % | 62 | 52 | 85 |

TABLE 1-continued

| | Comparative Example 1 | Example 1 | Example 1 |
|---|---|---|---|
| Hydrodesulfurization achieved, wt. % | 83 | 60 | 80 |
| Total feed capacity, BPSD | 25000 | 40000 | 17030 |
| LHSV 1/hr. | X | 2.2X | 1.5X |
| Number of Reactors | 3 | 1 | 2 |
| Reactor Operating Temp, ° C. | Y | Y + 15 | Y + 23 |
| Chemical Hydrogen Consumption, SCFH | Z | 1.25Z | 0.82Z |
| Total Reactor Volume, $m^3$ | A | 0.72A | 0.45A |
| Catalyst Addition Rate, lbs/Bbl | B | 0.75B | 0.25B |

The conversion, reactor temperature, and reactor liquid hourly space velocity for the operation of the reactors in both Example 1 and Comparative Example 1 are limited by the stability of the fuel oil, which typically must have a sediment content of less than 0.15 wt %, as measured by the Shell Hot Filtration Test (i.e. IP-375).

The reaction system parameters for Example 1 are supported by data obtained from pilot plant testing of both the straight run vacuum residue and the DAO derived from the unconverted hydrocracked vacuum residue. As a result of the reduced residue conversion from first stage reactor 14, the thermal operating severity (i.e. reactor temperature and space velocity) can be increased, compared with the reactors in Comparative Example 1, producing stable low sulfur fuel oil and without significantly affecting the sediment formation. This, in combination with the higher thermal severity at which the DAO conversion stage can be operated, enables 60% more vacuum resid feed to be processed at 22% higher conversion while requiring only an 18% increase in reactor volume. As a result of the higher conversion attainable with the flow scheme of Example 1, atmospheric and vacuum distillate production is increased from 64 vol % to 89 vol %, based on fresh vacuum resid feed.

In addition due to the reduced metals removal in the first reaction stage and the rejection of metals in the SDA pitch (asphalt recovered via stream 34) the unit catalyst addition rate (i.e., lbs per barrel of vacuum resid feed) can be reduced by 15% or more. Similarly, as a result of the reduced CCR and asphaltene conversion in the first reaction stage and the subsequent rejection of asphaltenes in the SDA pitch, light gas make and unit chemical hydrogen consumption is reduced by 10 to 15% than would otherwise be the case if the same conversion were achieved without integration of a SDA Unit.

As described above, embodiments disclosed herein provide for the efficient conversion of heavy hydrocarbons to lighter hydrocarbons via an integrated hydrocracking and solvent deasphalting process.

In one aspect, processes according to embodiments disclosed herein may be useful for attaining a high overall feed conversion in a hydrocracking process, such as greater than 60%, 85%, or 95% conversion.

In another aspect, processes according to embodiments disclosed herein may provide for reducing the required size of processing equipment, including at least one of a hydrocracking reactor and a solvent deasphalting unit. High conversions attained may result in relative recycle rates less than required by prior art processes to achieve high overall conversions. Additionally, hydrocracking at least a portion of the asphaltenes in the first reaction stage may provide for decreased feed rates, solvent usage, etc., associated with the solvent deasphalting unit as compared to prior art processes.

In yet another aspect, processes according to embodiments disclosed herein may provide for decreased catalyst fouling rates, thereby extending catalyst cycle times and catalyst lifespan. For example, operating conditions in the first reaction zone may be selected to minimize sediment formation and catalyst fouling that may otherwise occur when hydrocracking asphaltenes.

Significant reductions in capital and operating costs may be realized due to one or more of the low recycle requirements, efficient catalyst usage, and partial conversion of asphaltenes prior to solvent deasphalting.

Removal of asphaltenes in between the reaction stages may additionally result in a lower sediment deposition problem in equipment associated with separation of liquid from vapor in the reactor effluent circuit, including equipment in the fractionation section.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for upgrading resid, comprising:

feeding hydrogen and a resid hydrocarbon to a first reactor containing a first hydrocracking catalyst;

contacting the resid and hydrogen in the presence of the hydrocracking catalyst at conditions of temperature and pressure to crack at least a portion of the resid;

recovering an effluent from the first reactor;

feeding hydrogen and a deasphalted oil fraction to a second reactor containing a second hydrocracking catalyst;

contacting the deasphalted oil fraction and hydrogen in the presence of the second hydrocracking catalyst at conditions of temperature and pressure to crack at least a portion of the deasphalted oil;

recovering an effluent from the second reactor;

fractionating the first reactor effluent and the second reactor effluent to form at least one distillate hydrocarbon fraction and at least one resid hydrocarbon fraction;

feeding the at least one resid hydrocarbon fraction to a solvent deasphalting unit to provide an asphaltene fraction and the deasphalted oil fraction;

wherein the fractionating comprises:

separating the first and second reactor effluents in a high pressure high temperature separator to provide a gas phase product and a liquid phase product;

separating the liquid phase product in an atmospheric distillation tower to recover a fraction comprising hydrocarbons boiling in a range of atmospheric distillates and a first bottoms fraction comprising hydrocarbons having a normal boiling point of at least 340° C.;

separating the bottoms fraction in a vacuum distillation tower to recover a fraction comprising hydrocarbons boiling in a range of vacuum distillates and a second bottoms fraction comprising hydrocarbons having a boiling temperature of at least 480° C.;

feeding the second bottoms fraction to the solvent deasphalting unit as the resid hydrocarbon fraction.

2. The process of claim 1, wherein the fractionating comprises:

fractionating the first reactor effluent in a first separation system to form at least one distillate hydrocarbon fraction and a first resid hydrocarbon fraction; and fractionating the second reactor effluent in a second separation system to four at least one distillate hydrocarbon fraction and a second resid hydrocarbon fraction.

3. The process of claim 1, further comprising cooling the gas phase product to recover a hydrogen-containing gas fraction and a distillate fraction; and feeding the distillate fraction to the atmospheric distillation tower.

4. The process of claim 3, further comprising recycling at least a portion of the recovered hydrogen to at least one of the first reactor and the second reactor.

5. The process of claim 1, further comprising cooling the second bottoms fraction via direct heat exchange with at least one of a portion of the resid and a portion of the first bottoms fraction.

6. The process of claim 1, wherein at least one of an operating temperature and an operating pressure in the second reactor is greater than an operating temperature and an operating pressure of the first reactor.

7. The process of claim 1, wherein at least one of an operating temperature and an operating pressure in the second reactor is less than an operating temperature and an operating pressure of the first reactor.

8. The process of claim 1, wherein at least a portion of asphaltenes in the resid are hydrocracked in the first reaction stage.

9. The process of claim 1, further comprising operating the first reactor at a temperature and pressure to achieve a resid conversion in a range from about 30 wt. % to about 75 wt. %.

10. The process of claim 9, wherein the process achieves an overall resid conversion of at least 60 wt. %.

11. The process of claim 9, wherein the process achieves an overall resid conversion in the range from about 60 wt. % to about 95 wt. %.

12. The process of claim 1, wherein the resid hydrocarbon fraction comprises hydrocarbons with a normal boiling point of at least 480° C.

13. The process of claim 1, wherein the first reactor comprises a single ebullated bed reactor.

14. The process of claim 1, wherein the second reactor comprises at least one of an ebullated bed reactor and a fixed bed reactor.

15. The process of claim 1, wherein the fractionating comprises feeding the first reactor effluent and the second reactor effluent to a common fractionation system.

* * * * *

UNITED STATES PATENT AND TRADEMARK OFFICE

CERTIFICATE OF CORRECTION

PATENT NO. : 8,287,720 B2
APPLICATION NO. : 12/490089
DATED : October 16, 2012
INVENTOR(S) : Mario C. Baldassari et al.

It is certified that error appears in the above-identified patent and that said Letters Patent is hereby corrected as shown below:

In the Claims:

At column 11, claim 2, line 2, the word "four" should read -- form --.

Signed and Sealed this
First Day of January, 2013

David J. Kappos

David J. Kappos
*Director of the United States Patent and Trademark Office*